US010493341B2

(12) United States Patent
Sizer

(10) Patent No.: US 10,493,341 B2
(45) **Date of Patent: *Dec. 3, 2019**

(54) SPINNER BALL GAME APPARATUS AND METHOD

(71) Applicants: George F. Sizer, Killingworth, CT (US); Barbara J. Sizer, Killingworth, CT (US)

(72) Inventor: Mark Sizer, Haddam, CT (US)

(73) Assignees: George F. Sizer, Killingworth, CT (US); Barbara J. Sizer, Killingworth, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/295,184

(22) Filed: Mar. 7, 2019

(65) Prior Publication Data

US 2019/0201763 A1 Jul. 4, 2019

Related U.S. Application Data

(63) Continuation-in-part of application No. 15/729,710, filed on Oct. 11, 2017, now abandoned.

(60) Provisional application No. 62/407,115, filed on Oct. 12, 2016.

(51) Int. Cl.
*A63B 63/08* (2006.01)
*A63B 67/08* (2019.01)

(52) U.S. Cl.
CPC ..... *A63B 63/08* (2013.01); *A63B 67/08* (2013.01); *A63B 2207/02* (2013.01)

(58) Field of Classification Search
CPC ..... A63B 63/08; A63B 67/08; A63B 2207/02; A63B 67/06; A63F 7/22
USPC ..... 273/398–402; 473/485
See application file for complete search history.

(56) References Cited

U.S. PATENT DOCUMENTS 3,392,978 A * 7/1968 Wiest, Jr. ..... A63B 67/083 473/509
5,354,067 A * 10/1994 Junemann ..... A63B 67/06 273/371
7,614,600 B1 * 11/2009 Smith ..... G09F 23/00 135/16
7,785,240 B2 * 8/2010 Stugart ..... A63B 21/06 482/108
8,899,590 B1 * 12/2014 Kahn ..... A63B 67/002 273/342

(Continued)

*Primary Examiner* — John E Simms, Jr.
*Assistant Examiner* — Rayshun K Peng
(74) *Attorney, Agent, or Firm* — Michael A. Blake

(57) ABSTRACT

A spinner ball game apparatus comprising: a basket, the basket comprising an upper rim, and lower base, the upper rim having a diameter larger than the lower base; and a ball configured to be thrown into the basket and if properly thrown, able to make one revolution around the inner surface of the upper rim before falling into the lower base. A method of playing spinner ball, the method comprising: standing about 10 to 12 feet away from a basket; throwing a ball into the basket; scoring 3 points if the ball makes a complete revolution of the upper rim of the basket before falling into the bottom of the basket; scoring 2 points if the ball makes a complete revolution, but a portion of the revolution is below the upper rim; and scoring 1 point if the ball does not make a complete revolution but lands in the basket.

12 Claims, 9 Drawing Sheets

(56) References Cited

U.S. PATENT DOCUMENTS

| | | | | |
|---|---|---|---|---|
| 2012/0065004 | A1* | 3/2012 | Blackwell | A63B 67/06 473/476 |
| 2016/0121186 | A1* | 5/2016 | Sciandra | A63B 67/06 273/350 |

* cited by examiner

SPINNER BALL GAME APPARATUS AND METHOD

CROSS-REFERENCES

This patent application is a continuation-in-part of U.S. patent application Ser. No. 15/729,710 filed on Oct. 11, 2017, by Mark Sizer and titled: "Spinner Ball Game Apparatus and Method" which application is fully incorporated by reference herein. U.S. patent application Ser. No. 15/729,710 claims priority to provisional patent application No. 62/407,115 filed on Oct. 12, 2016, by Mark Sizer and titled: "Spinner Ball Game and Apparatus" which provisional application is fully incorporated by reference herein.

TECHNICAL FIELD

The present invention relates to a game that can be played outdoors and indoors, and more particularly to a game that uses balls, and a basket to spin the balls into.

BACKGROUND

There are other known basketball style games, but none known that can be played by people of almost all ages.

Thus there is a need for a game apparatus and method that overcomes the above listed and other disadvantages.

SUMMARY OF THE INVENTION

The disclosed invention relates to a spinner ball game apparatus comprising: a basket, the basket comprising an upper rim, and lower base, the upper rim having a diameter larger than the lower base; and a ball configured to be thrown into the basket and if properly thrown, able to make one revolution around the inner surface of the upper rim before falling into the lower base.

In addition, the invention relates to a method of playing spinner ball, the method comprising: standing about 10 to 12 feet away from a basket; throwing a ball into the basket; scoring 3 points if the ball makes a complete revolution of the upper rim of the basket before falling into the bottom of the basket; scoring 2 points if the ball makes a complete revolution, but a portion of the revolution is below the upper rim; and scoring 1 point if the ball does not make a complete revolution but lands in the basket.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION OF THE INVENTION

Figure 1:
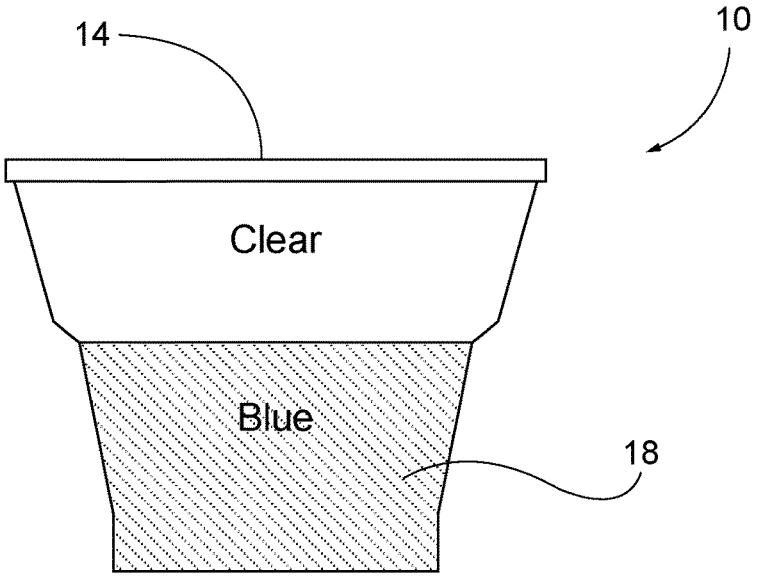
FIG. 1 is a side view of the spinner ball basket.

This new game is an improvement on a basketball game. See FIG. 1. The device comprises at least one container, which may also be called a basket 10. The basket 10 has an upper rim 14 and bottom base 18. The upper rim 14 may be transparent, translucent, partially transparent, partially translucent, or the entire rim and base may be transparent, translucent, partially transparent, or partially translucent. The idea is to shoot a ball into the basket 10, and try to make the ball spin around the rim 14 at least once (360°) before it comes to rest. The basket 10 may be about 18" in diameter at the rim, and about 15" tall. The basket 10 can be set on a floor, or table top. The upper rim 14 will have a larger diameter than the bottom base 18. The basket 10 will not tip over, because the base has a removable container 22 that can be filled with water, sand, or other suitable material, see FIG. 2.

Figure 2:
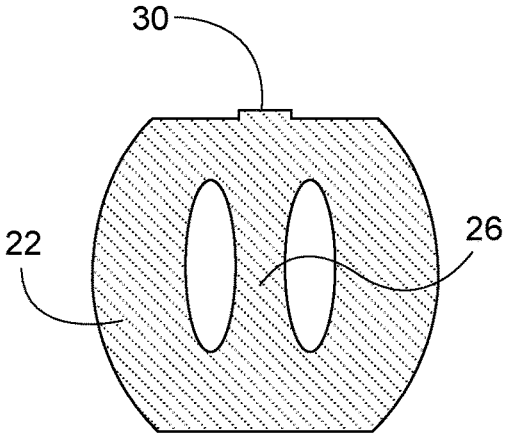
FIG. 2 is a top view of the weightable container.

FIG. 2 is a top view of the container 22 that slides into the base 18. The container 22 may have a handle 26 and a removable cap 30. The cap 30 can be removed when filling or emptying the container.

Figure 3:
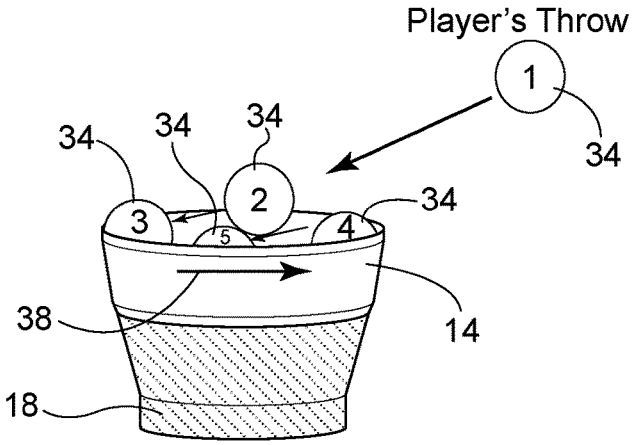
FIG. 3 is a perspective view of the spinner ball apparatus.

FIG. 3 shows a successful shot with a ball 34, with the ball 34 shown spinning around the rim, each location of the ball is sequentially numbered 1-5. The ball can be seen at the various locations (2, 3, 4, 5) spinning around the rim 14 in the direction of the arrow 38. Of course, the ball 34 can be spun around the rim 14 in a direction opposite the arrow 38.

Figure 4:
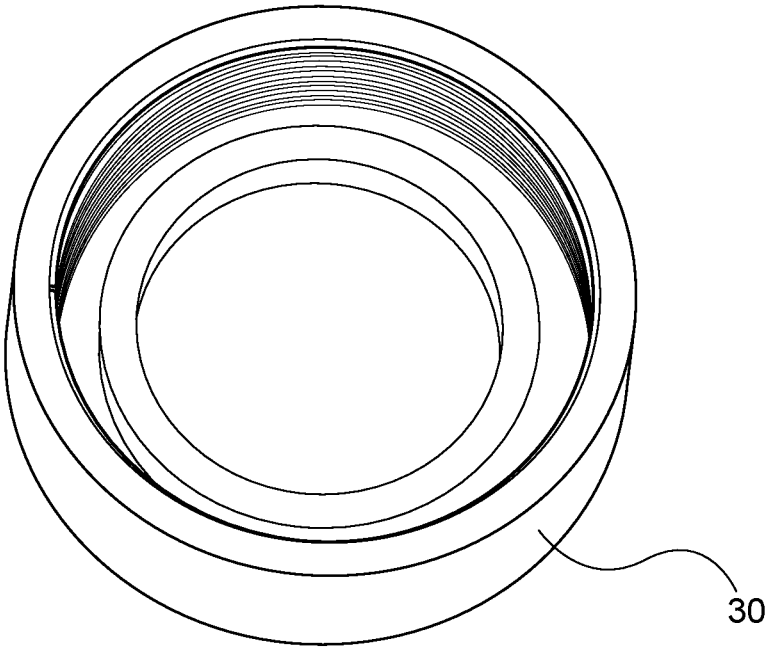
FIG. 4 is a top view of the weightable container.

FIG. 4 shows a top perspective view of the removable cap 30 from FIG. 2.

Figure 5:
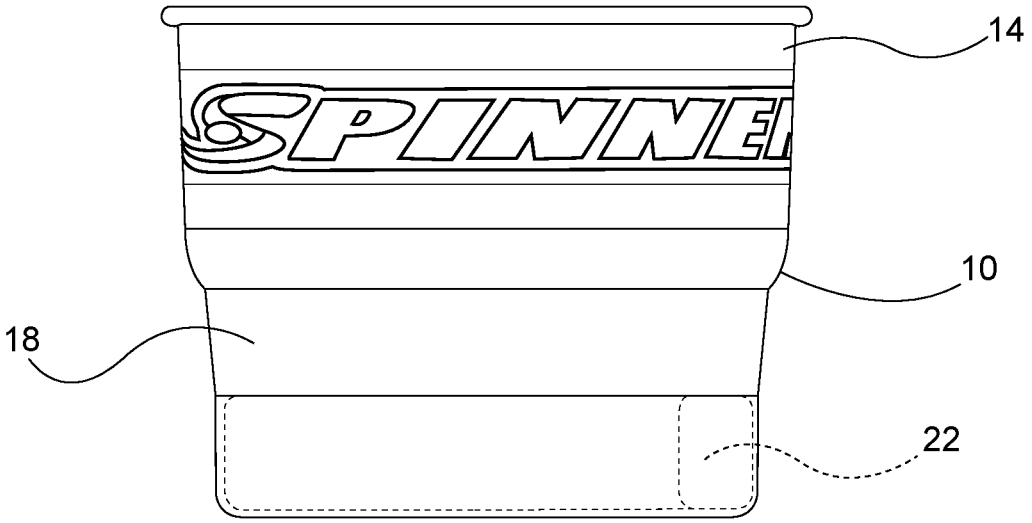
FIG. 5 is a side view of the spinner ball basket with the weightable container in the bottom of the basket.

FIG. 5 shows a front view of the basket 10. In this embodiment, the basket 10 is generally transparent. The removable container 22 can be seen in the bottom base 18 of the basket 10.

Figure 6:
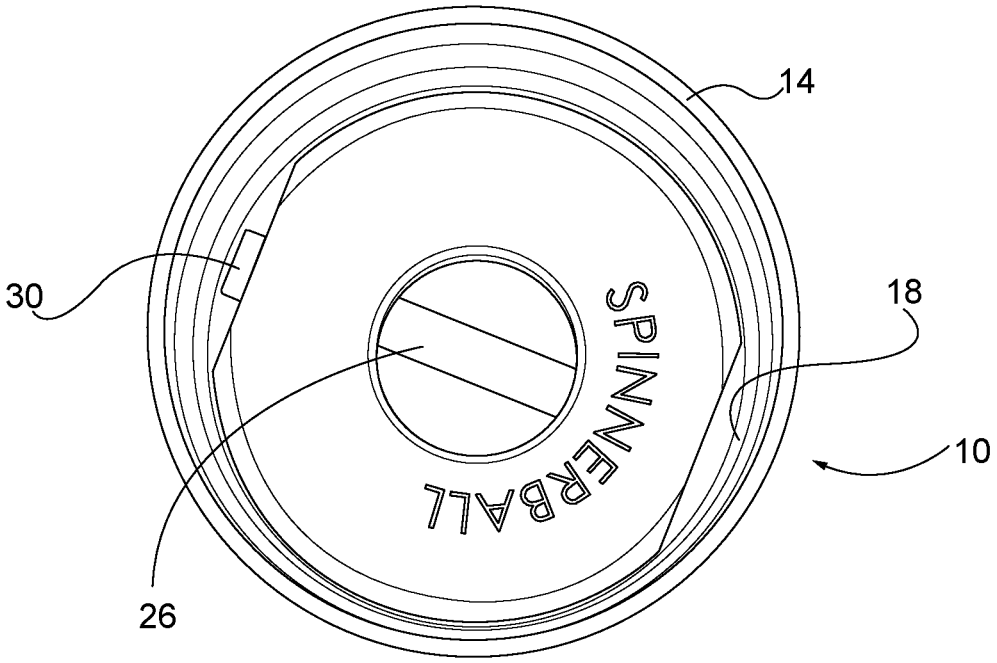
FIG. 6 is a top perspective view of the rim and base with the container at the bottom of the base.

FIG. 6 shows a top view of the basket 10 with the removable container 22 in the bottom base 18.

Figure 7:
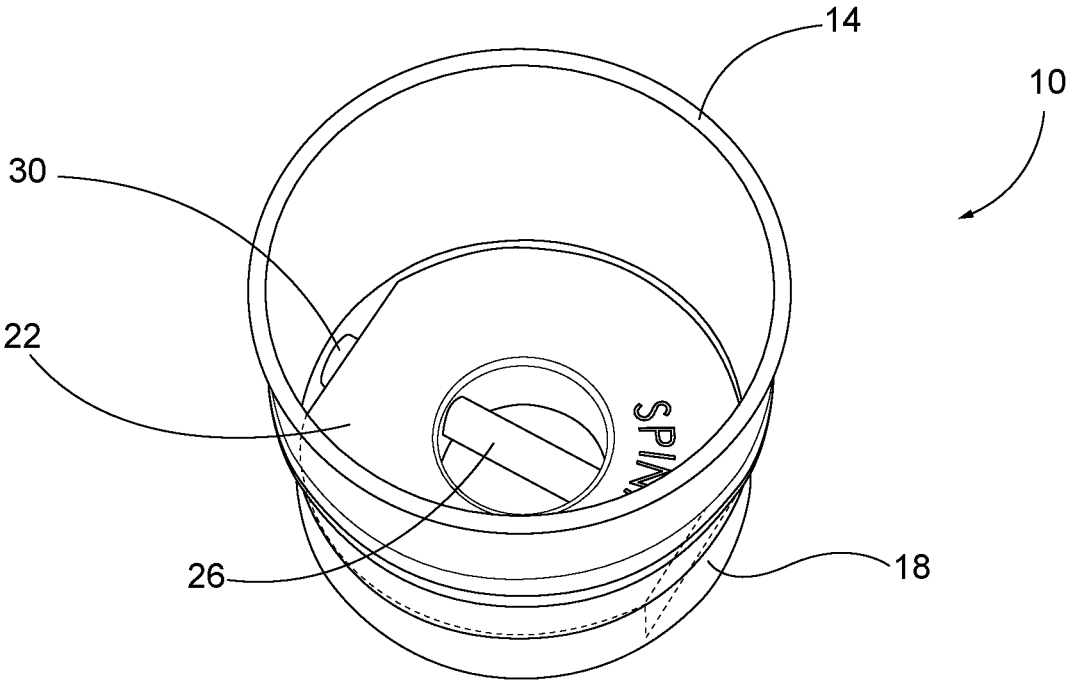
FIG. 7 is a perspective view of the rim and base from FIG. 6.

FIG. 7 is a top perspective view of the basket 10 from FIG. 6.

Figure 8:
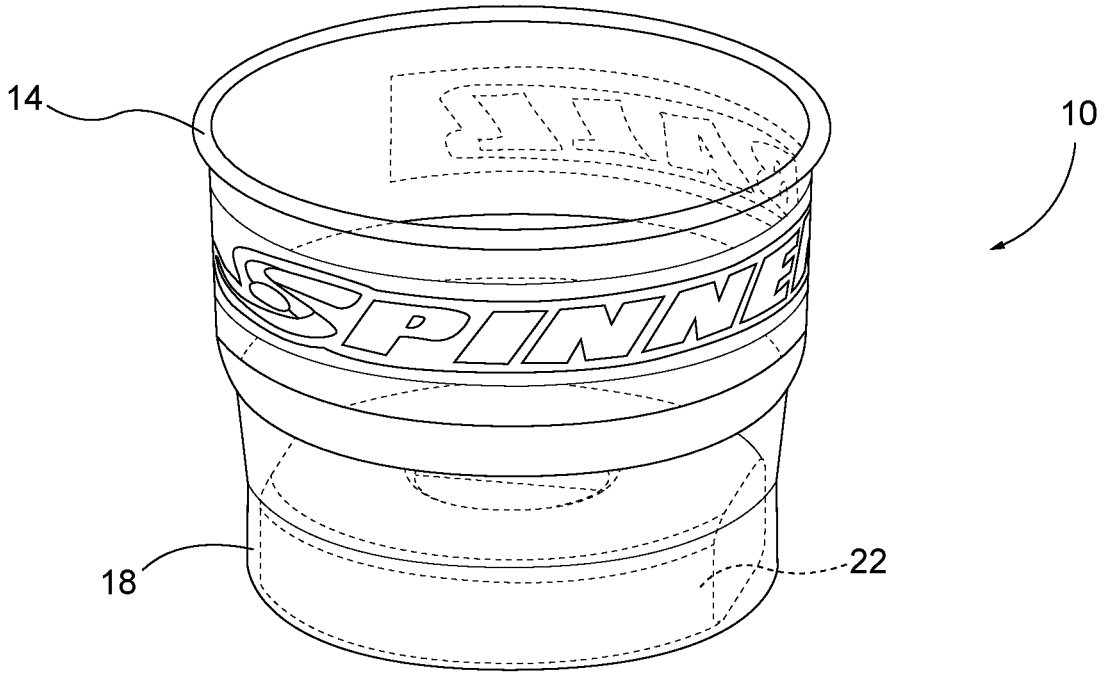
FIG. 8 is a perspective view of the basket.

FIG. 8 is a front perspective view of the basket from FIG. 6.

Figure 9:
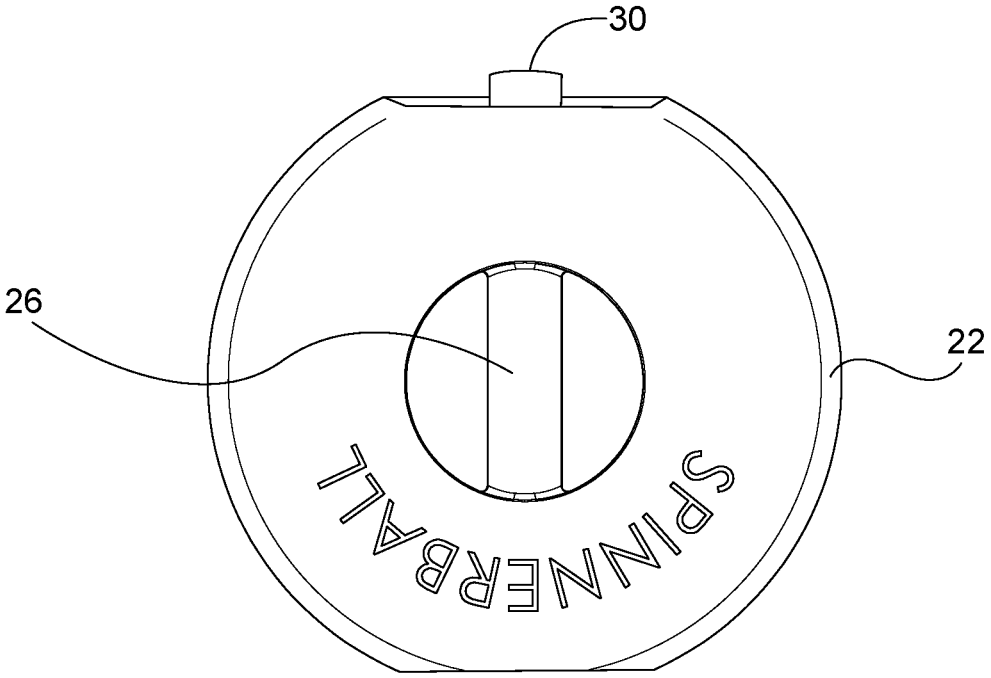
FIG. 9 is a top view of the weightable container.

FIG. 9 is a top view of the removable container 22 from FIG. 6.

Figure 10:
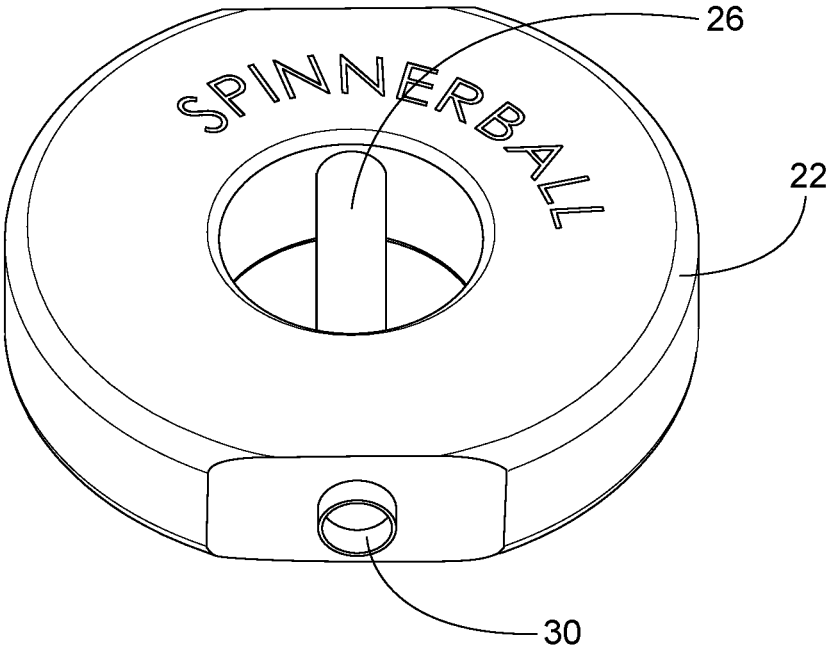
FIG. 10 is a perspective view of the container and the cap removed from the container.

FIG. 10 is a front perspective view of the removable container 22 from FIG. 9.

Figure 11:
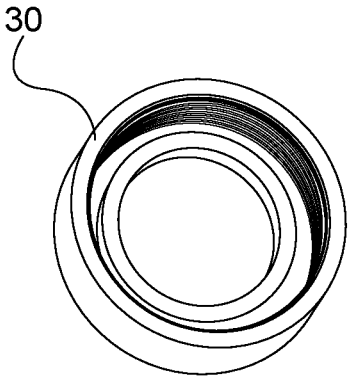
FIG. 11 is a perspective view of the removable cap.

FIG. 11 is a perspective view of the removable cap 30.

Figure 12:
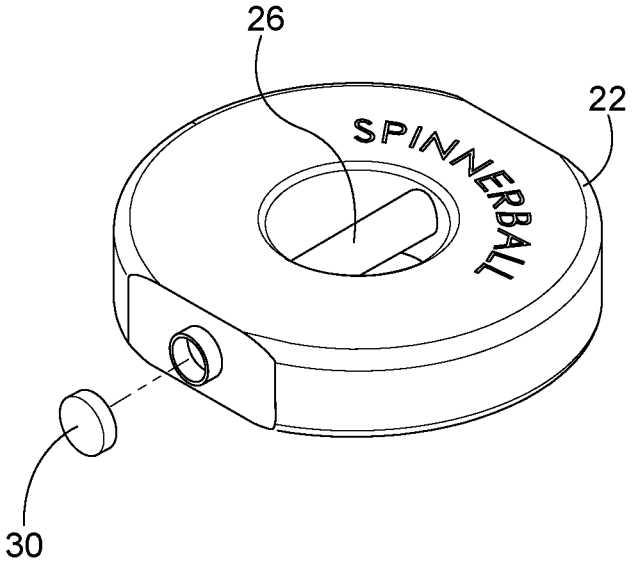
FIG. 12 is a exploded view of the weightable container and cap.

FIG. 12 is an exploded view of the removable container 22 and removable cap 30.

Figure 13:
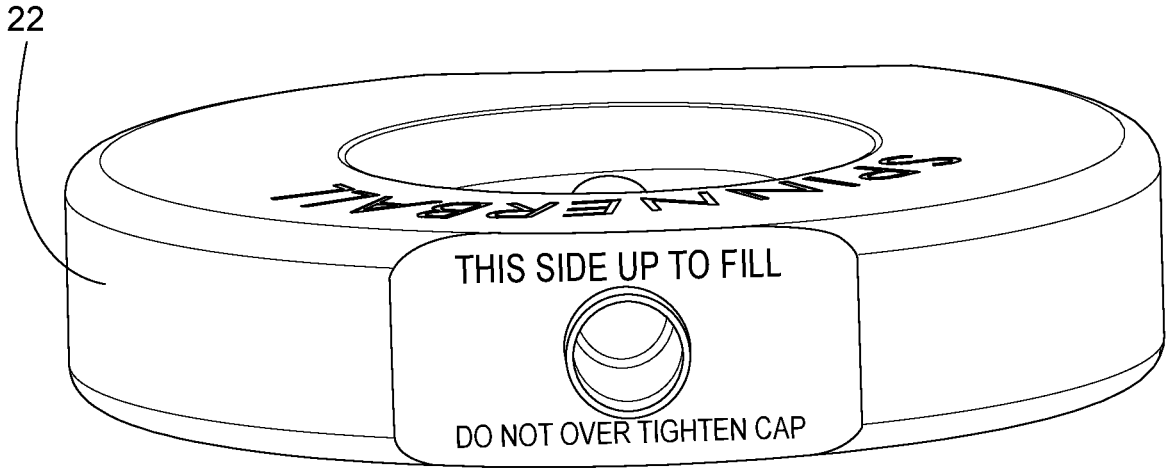
FIG. 13 is a side perspective view of the weightable container with the cap removed.

FIG. 13 is a front perspective view of the removable container 22 with the removable cap 30 removed. In this view the container opening 42 is visible. The user can fill or empty the container 22 via the container opening 42. The container 22 can be filled with water, sand, or other suitable fluid or material.

Figure 14:
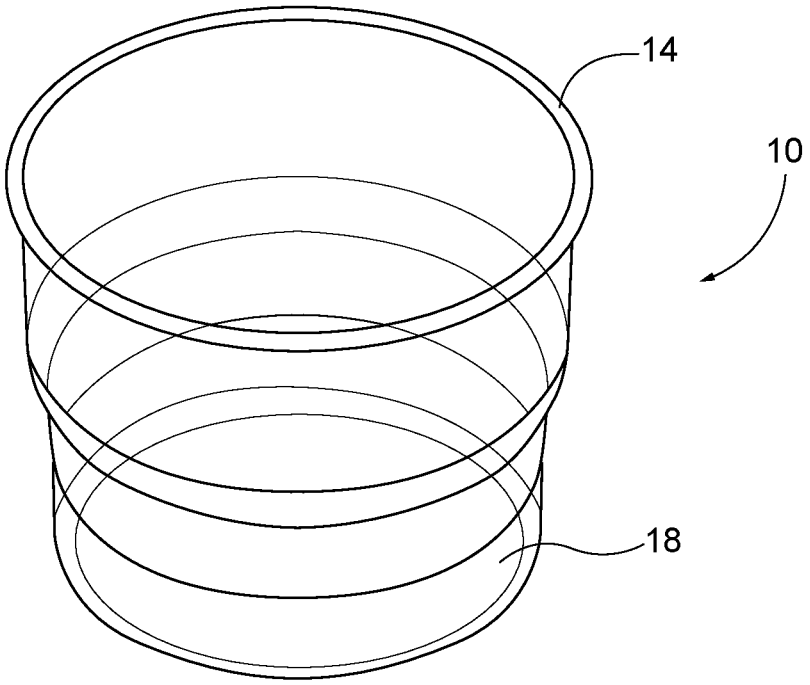
FIG. 14 is a front perspective view of a transparent basket.

FIG. 14 is a front perspective view of a generally transparent basket 10 with the removable container 22 removed.

Figure 15:
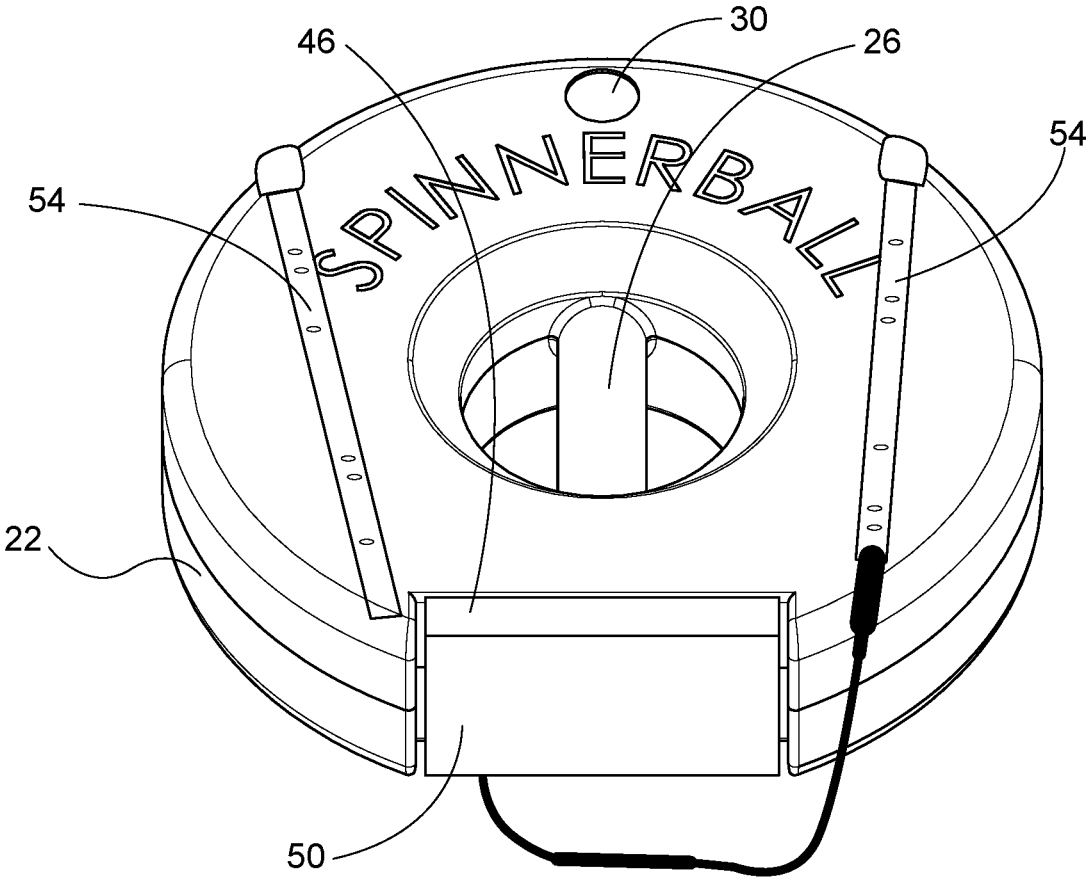
FIG. 15 is a top perspective view of the weightable container with the lights kit installed.

FIG. 15 is another embodiment of the removable container 22. In this embodiment the container has a cutout 46 configured to hold a battery pack 50, while still maintaining the integrity of the container such that the container can hold liquid or sand, or similar material. The battery pack 50 is in communication with light strips 54 that are adhereable to a top surface of the container 22. The light strips may comprise led lights. Thus, when playing the spinner ball game, the lights can be turned on, to give an interesting light effect while playing the game. The battery pack 50, and light strips 54 can be sold separately and added to the spinner ball game at a later time.

Figure 16:
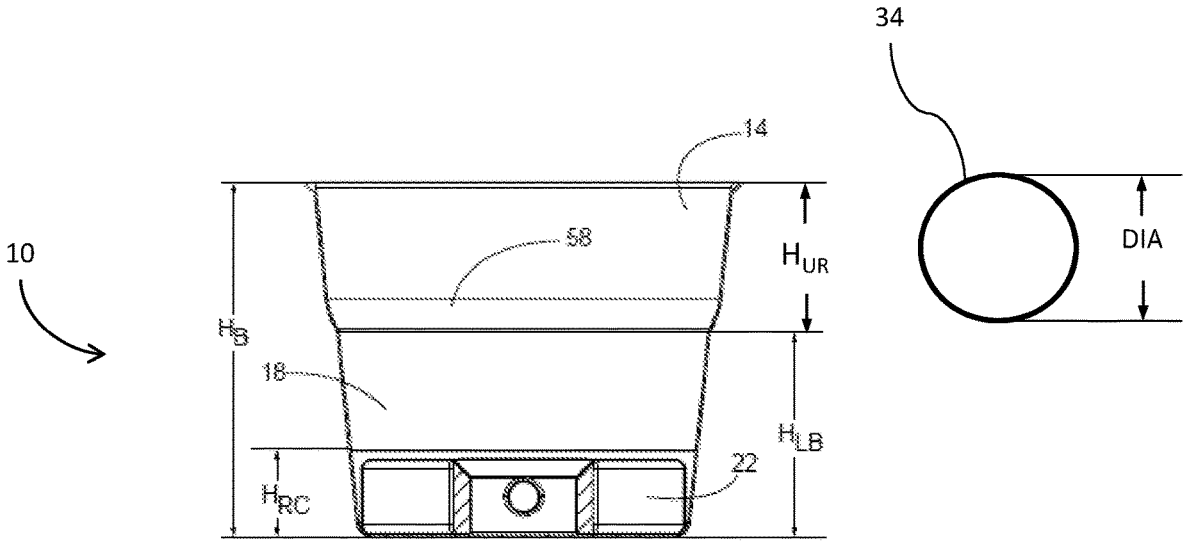
FIG. 16 is a side view of the basket and weightable container.

FIG. 16 is a front view of another embodiment of the basket 10 and ball 34. The ball 34 has a diameter DIA. The basket has a height $H_B$. The upper rim 14 has a height $H_{UR}$. The lower base 18 has a height $H_{LB}$. The removable container 22 has a height $H_{RC}$. The upper rim 14 may have a curved portion 58. The curved portion 58 may have a radius equal to about ½ the diameter DIA of the ball 34. Because the curved portion 58 has a radius equal to the radius of the ball 34, this will allow the ball 34 to tend to travel in the curved portion 58 while spinning about the upper rim 14. The ball 34 will fit in the curved portion 58, because they have generally the same radiuses. This will make for a more enjoyable and fun game, because the ball will tend to spin about the interior of the upper rim 14 for longer periods of time. In one embodiment, $H_{RC}$ will be no more than ½ of $H_{LB}$. In one embodiment, the height $H_{UR}$ will be equal to the diameter DIA of the ball 34. This will allow players to generally see the entire ball 34 as it is spinning about the transparent inner upper rim 14. In one embodiment the upper rim 14 will be transparent or translucent. In another embodiment, the entire basket 10 will be transparent or translucent. In one embodiment, the basket 10 will be made out of one piece of material, such as plastic. The entire basket 10 may be made as one piece by injected molding. The basket 10 may be made out of polypropylene. Making the basket 10 out of one piece of material, by processes such as injection molding will keep the cost of manufacturing down, and keep the weight of the basket 10 low. In one embodiment, the diameter DIA of the ball 34 may be about 6 inches, and the height of the upper rim $H_{UR}$ may be 6 inches, and the radius of the curved portion 58 may be 3 inches. The 6 inch size for the ball 34 is conducive to ease of play, and ability to get the ball 34 to spin about the inner upper rim 14 of the basket 10.

Figure 17:
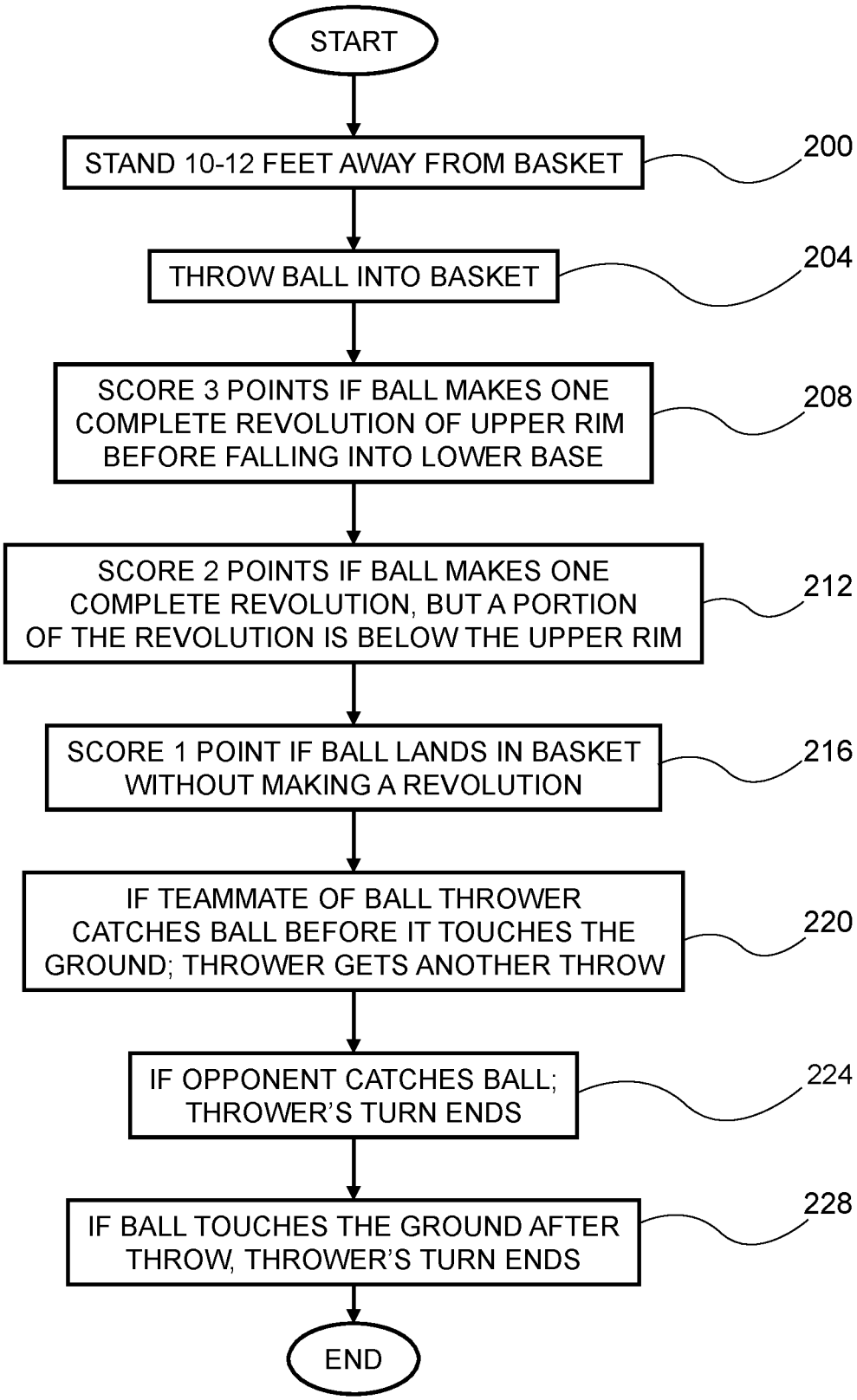
FIG. 17 is a flowchart of a method of playing the game.

FIG. 17 is a flowchart showing one embodiment of how to play the disclosed spinner ball game. At act 200, the first thrower stands about 10 to 12 feet away from the basket. At act 204, the thrower tries to throw the ball into the basket. At act 208, the thrower score 3 points if the ball makes a complete revolution of the upper rim of the basket before falling into the bottom of the basket. At act 212, the thrower scores 2 points if the ball makes a complete revolution, but a portion of the revolution is below the upper rim. At act 216 the thrower scores 1 point if the ball does not make a complete revolution but lands in the basket. At act 220, if the teammate of the thrower catches the ball before it hits the ground, the thrower gets another throw. At act 224, if the opponent catches the ball, the thrower's turn ends with no points for the thrower. At act 228, if the ball touches the ground, the thrower's turn ends with no points.

Some of the novel features are, a rim configured to promote the 360° spinning of the ball, the rim is clear so one can see the spinning of the ball inside the rim, a weighted container that fits in the base of the basket. The container is configured to have a built-in handle to allow easy removal and installation of the container out of an into the basket base. One or more baskets may be used in a game of "Spinner ball".

One embodiment of the rules of the spinner ball game may be as follows:

"How is Spinner ball Played? The objective in the game of Spinner ball is to toss the ball into the opposing team's basket scoring points for your team. Points are earned when a player makes a Spinner ball, a Spinner or if the ball makes it in the basket after a toss. A Spinner ball (3 points) is when the ball rotates a 360 degree rotation around the inside of the basket above or on the curve in the basket. A Spinner (2 points) is when the ball rotates a 360 degree rotation around the inside of the basket before touching the insert. A player receives (1) point for getting the ball in the basket. Spinner ball can be played with one person against another person or with two teams of two. If played with a teammate, one player from each team plays on each side of the basket. If a ball is in the basket it shall be removed before the next player has a turn. If a player gets a Spinner ball or a Spinner he/she is awarded another turn to toss the ball. This can only happen (2) times per player turn. The first player or team to reach a score of 21, 25, or 33 wins. You decide what score you want to play to before the game starts! The player tossing the ball cannot pass the front of the basket while taking their turn.

Who goes first? To determine who goes first, a player from each side will take a turn to toss the ball. The player who scores the highest goes first. If no points are scored, the opposing player(s) may have a turn.

Defense? If the ball bounces off or out of the basket, the ball may be caught or deflected to the ground by the opposing team. If the ball is caught by a teammate, the ball goes back to their teammate for another turn. When the ball hits the ground the turn is completed.

Spinner ball 360 advanced team play? This game requires teams of 2 or 3 players. This game may be played 360 degrees around the basket. One basket is to be placed in the center of a clear and flat area approximately 30 feet by 30 feet. Players may choose to mark a line 5 feet from the rim of the basket 360 degrees around the basket to complete a circle. This is repeated from the first line 5 feet away from the basket-completing a second line 10 feet from the basket. The 5 foot circle designates where a player cannot go or toss from during a turn. The 10 foot circle designates where the next player can begin their toss once the opposing team completes their turn. The team whose turn is it is to toss may toss the ball to a teammate or to the basket. The opposing team may defend a pass or a toss. There are no rebounds in this version. The team turn/aim for the basket is over when the ball touches the ground or the other team possesses or deflects the toss to the ground. This results in the other team getting a turn which may begin when the ball crosses the 10 foot line.

How do I assemble the game? The game provides (2) baskets which are to be placed at a distance of 12 feet apart from the face of one basket to the face of the other basket. The game provides two inserts that are to be filled with sand or water. A funnel is recommended for both filling options. To fill with SAND: Use a funnel and fill halfway with sand. You may need to shake to level the sand. Secure plug. To fill with WATER: Use a funnel and fill insert all the way to the top with water. Secure plug. When using water, we recommend draining the insert after use and storing with the plug off. After the insert is filled, properly place one insert in each basket with the plug facing upward.

How do I install the LED light kit? Install 8 AA batteries without damaging the power pack, a small Phillips screw driver will be needed. Refer to pics on the web site for location. Make sure the top of the insert is facing up, plug side. Make sure the switch and wires are facing upward. Remove the 3M adhesive backing and secure the battery pack in the area provided holding firmly for a few seconds. Remove the 3M backing of the LED light strip and apply the light strip to the top of the insert as shown. Press firmly to ensure proper adhesive application.

Warnings: Play this game on a flat surface. DO NOT play Spinner ball on or near a hill, in a parking lot, in a road/street, on a slippery or wet surface or anyplace that could possibly lead to injury. Do not freeze if water was used to fill insert. This is a no contact game. Do not fill the basket with water. Do not use for bathing children. Children must be supervised while playing Spinner ball.

Questions? View our tutorial and demonstration videos online at www.spinnerballgame.com! Future options: Glow in the dark or illuminating ball, glow in the dark basket and insert, collapsible version, a line or tape line marking the spinner ball/spinner curve, floating version, mobile game app Tabletop version."

Attached as appendix A is one embodiment of the rules of the spinner ball game.

The disclosed spinner ball game and apparatus has many advantages. It is easy to set up and begin playing. The rules are simple. The entire game and apparatus can be stored in the stackable baskets. The game can be played at night or in the dark with the light kit installed.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A spinner ball game apparatus comprising:

a basket, the basket comprising:

a generally transparent upper basket portion with an upper basket portion radius;

a curved chamfer abutting the bottom of the upper basket portion, the curved chamfer having a curved chamfer radius;

a lower basket portion abutting the curved chamfer, the lower basket portion having a lower basket portion radius, and wherein the upper basket portion radius is larger than the lower basket portion radius;

a ball configured to be thrown into the basket and if properly thrown, able to make one revolution around the inner surface of the upper basket portion before falling into the lower basket portion, the ball having a radius, and the radius of the ball is generally equal to the radius of the curved chamfer, and where the upper basket portion radius, is at least twice the radius of the curved chamfer and the ball; and wherein the basket is formed from a single piece of plastic.

2. The spinner ball game apparatus of claim 1, wherein the upper basket portion has a height, and the height of the upper basket portion is generally equal to the diameter of the ball.

3. The spinner gall game apparatus of claim 1, further comprising:

a weighted container configured to sit inside the lower basket portion, and further configured to prevent the basket from tipping over and or excessively moving when a ball is thrown into the basket.

4. The spinner ball game apparatus of claim 3, wherein the weighted container is less than half the height of the lower basket portion.

5. The spinner ball game apparatus of claim 3, wherein the weighted container further comprises a removable cap, and the weighted container is configured to hold a fluid or particulate matter in order to add weight to the weighted container.

6. The spinner ball game apparatus of claim 3, wherein the weighted container further comprises:

a generally circular shape with an inner circumference and an outer circumference;

a handle located generally in the center of the weighted container, the handle comprising a generally straight member attached to a first area on the inner circumference, and the handle also attached to a second area on the inner circumference, the second area located generally opposite the first area.

7. The spinner ball game apparatus of claim 3, wherein the weighted container further comprises a cutout configured to house a battery pack.

8. The spinner ball game apparatus of claim 7, further comprising:

a battery pack configured to be housed in the cutout;

at least one light strip in communication with the battery pack, and configured to attach to the top surface of the weighted container.

9. The spinner ball game apparatus of claim 8, wherein the light strip comprises one or more led lights.

10. The spinner ball game apparatus of claim 1, wherein the entire basket is generally transparent.

11. The spinner ball game apparatus of claim 1, wherein the basket is formed by injecting molding of polypropylene.

12. The spinner ball game apparatus of claim 2, wherein the upper basket portion height and the diameter of the ball are equal to about 6 inches, and the radius of the curved chamfer is equal to about 3 inches.

* * * * *